US006513759B2

(12) United States Patent
Starbuck

(10) Patent No.: US 6,513,759 B2
(45) Date of Patent: Feb. 4, 2003

(54) SPORTS KITES

(75) Inventor: David Starbuck, Kula, HI (US)

(73) Assignee: Neil Pryde Limited (HK)

( * ) Notice: Subject to any disclaimer, the term of this patent is extended or adjusted under 35 U.S.C. 154(b) by 0 days.

(21) Appl. No.: 09/804,282

(22) Filed: Mar. 12, 2001

(65) Prior Publication Data

US 2002/0124782 A1 Sep. 12, 2002

(51) Int. Cl.[7] ..... B64C 31/06

(52) U.S. Cl. ..... 244/155 A; 114/39.13; 114/39.16; 114/39.18

(58) Field of Search ..... 114/39.13, 39.16, 114/39.18, 102.1, 102.11, 102.16; 280/810; 244/155 R, 155 A, 153 R

(56) References Cited

U.S. PATENT DOCUMENTS 4,127,247 A * 11/1978 Strasilla ..... 244/151 A
5,366,182 A * 11/1994 Roeseler et al. ..... 114/102.11
6,273,369 B1 * 8/2001 Nishimura et al. ..... 244/153 R

* cited by examiner

*Primary Examiner*—Sherman Basinger
(74) *Attorney, Agent, or Firm*—Jackson Walker L.L.P.

(57) ABSTRACT

A control device for a surfer's sports kite has a hand-holdable elongate control bar for steering the kite. A central control line is used for changing the effective curvature of the kite and therefore the power generated by the kite. The control device includes an open-top body mounted at the center of the control bar and attached to a harness loop. The harness loop is arranged to be attached to a harness hook of the surfer in use. A stopper fixed on the control line fits in the body. On the one hand, the stopper is shaped to maintain the line (and hence the harness loop) in particular orientations for ease of fitting the loop to the hook. On the other hand, when the ball is moved to the right in the Figure, the ball is free to rotate to allow the surfer to untwist the control lines, when required.

4 Claims, 2 Drawing Sheets

SPORTS KITES

BACKGROUND OF THE INVENTION

1. Field of the Invention

The invention relates to sports kites.

2. Description of Prior Art

The invention relates to kites used for kite-surfing and similar sports where the kite is used and controlled by a surfer, say, to propel and sometimes lift the surfer during use. The surfer can control the power generated by the kite by manipulating control lines to alter the effective curvature of the kite canopy in a manner well understood.

In the most common basic kites, the surfer (sailor) uses a bar with two lines, one at each end of the bar. He controls the direction of the kite by pulling on the left of the bar to go left and on the right to go right.

Typically, the kite is provided with control bar with lines extending to the kite canopy; and it has already been proposed to have a control bar where three control lines are used. Sidelines are attached to respective bars on (side) tips of the kite and a centre line is attached to both forward sides on a leading edge of the kite. If the control bar is lowered (pulled down) or raised by the surfer so that the side lines are pulled down or released relative to the centre line, the angle at which the canopy passes through the air is reduced or increased (referred to as "angle of attack" in aviation terms) which reduces or increases the lifting force. This in turn increases or decreases the effective power generated by the kite.

It is already known to arrange for the control bar to be attachable by a harness loop that can be placed onto a suitable hook, say, on a surfer's harness. The loop is brought into the hook from underneath.

In a present arrangement, the control bar is attached to the harness loop by a releasable friction lock applied to the central control line. The control bar has a central aperture to receive the central line and when the control bar aperture is 'in line' with the central line, the line is generally free to slide through the aperture. The lines are attached to the control bar so that with hands off the central control line is normally locked. If the control bar is rotated by say 90° about it's longitudinal axis, the central line is frictionally unlocked and can slide through the aperture. Such a frictional locking arrangement is not wholly reliable in its locking function of the central line and normal usage tends to cause abrasion of the central line. Further, the harness loop is free to adopt random orientations with respect to the control bar and so can be difficult engage on a harness hook during use.

SUMMARY OF THE INVENTION

It is an object of the invention to overcome or at least reduce some or all these problems.

According to the invention there is provided a sports kite power control device comprising an elongate rigid control bar extending either side of a central region to provide separated hand-grippable regions for a kite user adjacent anchor points for respective opposite side control lines of the kite, an open-top lock body mounted to the central region, a central control line attached to a harness loop at one end and extending from the harness loop towards leading edges of the kite, including a stopper rigidly fixed to the central line adjacent its remote end that can be releasably fitted into the lock body through the open top and when fitted locks the central control line to restrain movement of the control line relative to the control bar in a direction towards and away from the kite.

The stopper preferably has a shaped forward end, towards the kite, that can fit snugly against an inner mating surface of the lock body arranged to maintain the axis of the central line in a predetermined relative orientation to the lock body and hence maintain the harness loop in a predetermined relative orientation for easy fitting to a harness hook.

The stopper preferably has a shaped rear end, away from the kite, that can fit against an inner mating surface of the lock body arranged to permit axial rotation of the central line with respect to the lock body.

The stopper may be an integral component having a wedge shaped forward end and a spherical shaped rear end.

BRIEF DESCRIPTION OF THE DRAWINGS

A power control device for a kite surfer according to the invention will now be described by way of example with reference to the accompanying drawings in which.

DESCRIPTION OF THE PREFERRED EMBODIMENTS

Figure 1:
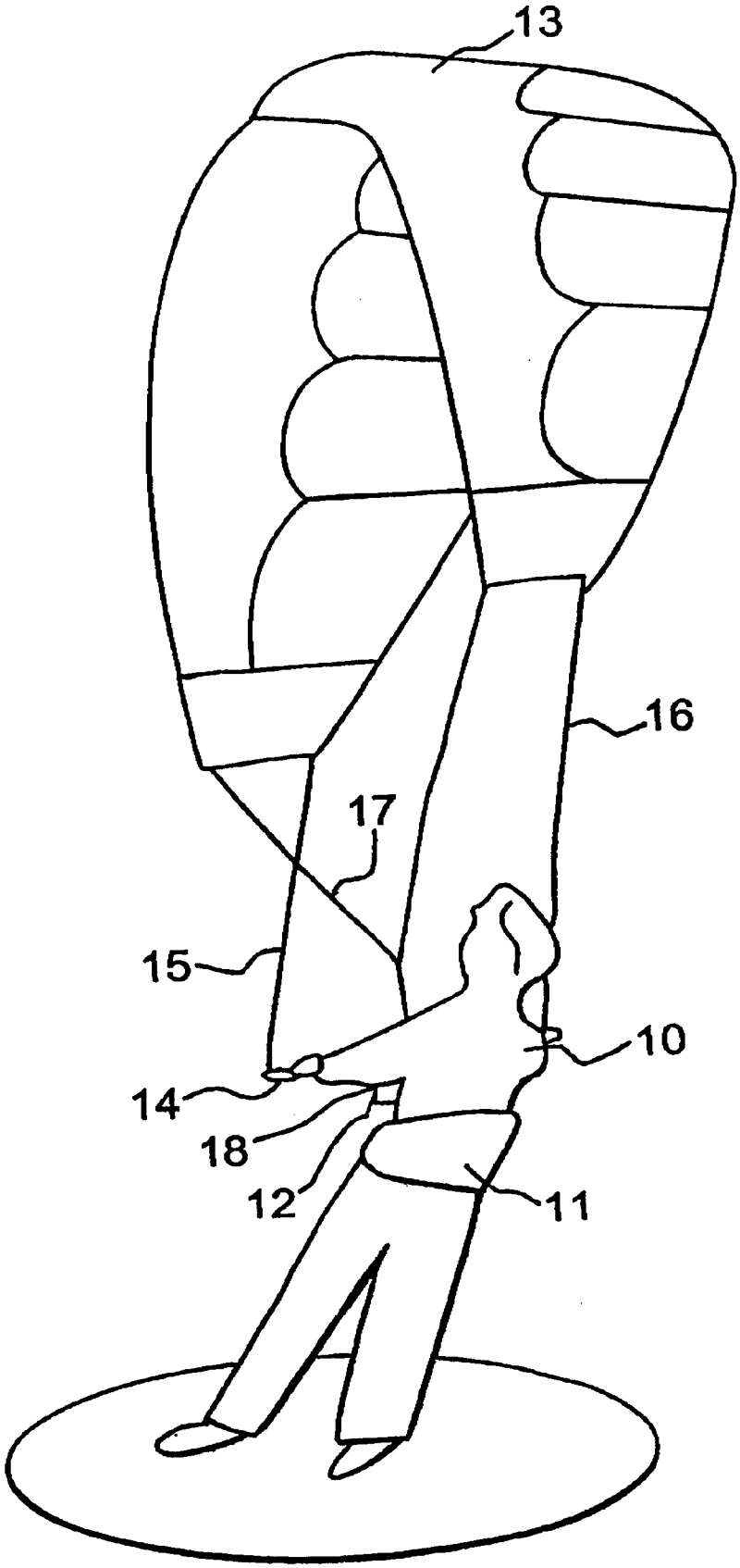
FIG. 1 is an isometric view of the surfer and the kite.

Referring to the drawings, in FIG. 1 a surfer 10 has waistband 11 provided with a conventional hook 12. A kite 13 is connected to a control bar 14 by two side control lines 15 and 16 and a central control line 17, in a manner already proposed for sports kites. A harness loop 18 is attached to the hook 12.

Figure 2:
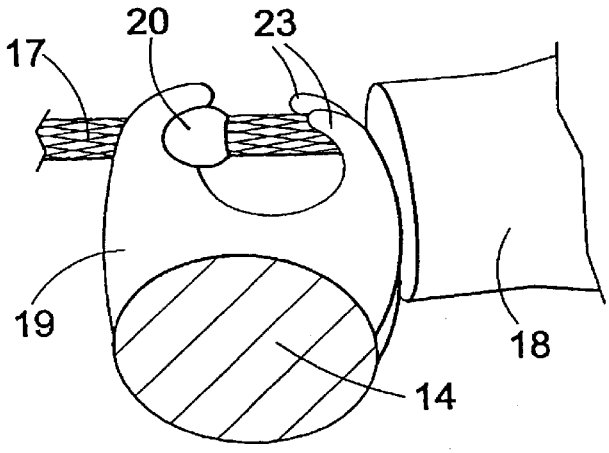
FIG. 2 shows an isometric side view of a locking arrangement for locking a central line to a control bar.
Figure 3:
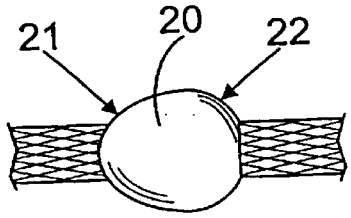
FIG. 3 is an isometric view of a stopper for the locking arrangement.

FIG. 2 shows a novel locking arrangement for releasably locking the central control line 17 to the control bar 14. The locking arrangement consists of an open top body 19 that fits rigidly at a central region of the control bar and non-uniform metal bar 20 (see FIG. 3) that is rigidly fixed to the central control line 17. The ball 20 acts as a stopper and can be releasably fitted into the lock body through the open top as required. The ball 20 is fitted into a fork of the lock body through the top of the lock body 19. When the ball 20 is in the body, as shown in FIG. 2, the central line is restrained in moving towards the kite or away from the kite. The ball 20 has a forward end 21 that is wedge shaped to fit snugly against a mating inner surface of the body 19. When the ball is in the position shown in FIG. 2, the central control line 17 is maintained in a specific axial orientation to the body 19 and hence to the control bar 14. As a result, the harness loop 18 is held in an orientation that in practice in a plane parallel to the control bar to facilitate attaching the harness loop 18 to the hook 12 when required. No such provision is made in prior art arrangement and as a result the central line and hence the harness loop are otherwise free to rotate, the harness loop can adopt orientations making it impossible or very difficult to engage the hook during normal use.

A rear end 22 of the ball 20 is spherical and is arranged to mate with a spherical inner surface of the body formed between two guide hooks 23. If the ball 20 is held against the surface between the hooks 23, the centre line 17 and the harness hoop is free to rotate relative to the control bar about the central line 17. This allows the surfer to 'spin' the control bar as may be required after any maneuvers that cause the side lines to twist together.

Figure 4:
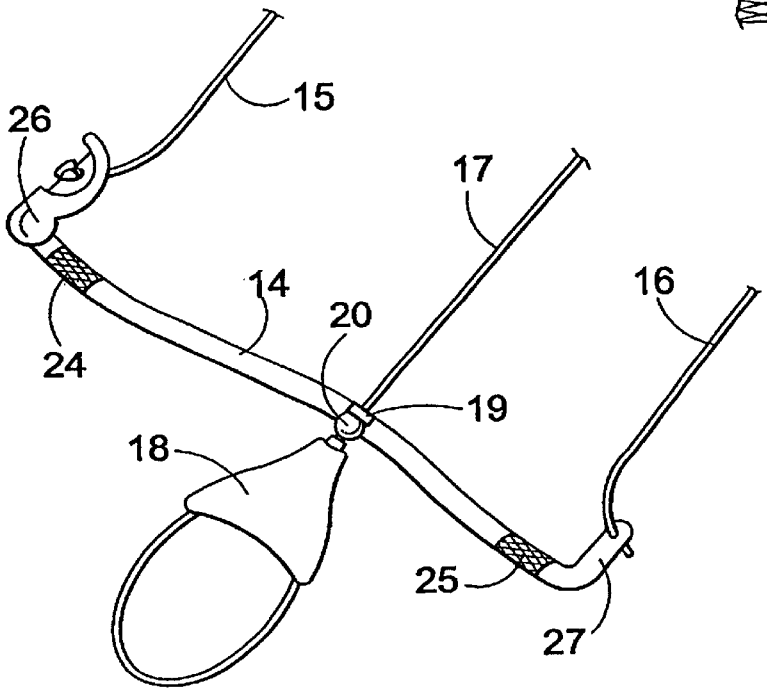
FIG. 4 is an isometric view of the control bar with the central line locked with respect to the control bar.
Figure 5:
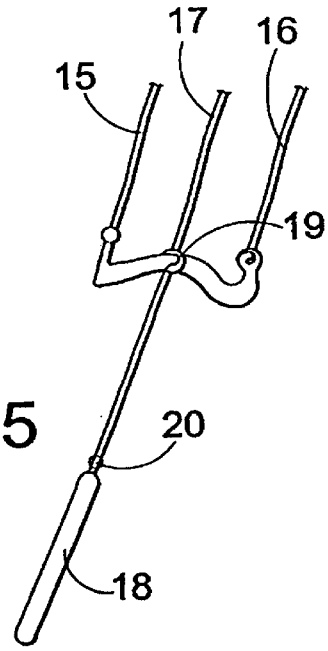
FIG. 5 is isometric view of with the central line unlocked with the control bar.

In FIGS. 4 and 5, the rigid control bar 14 extends either side of the central region where the lock body is fixed to provide separated hand-grippable regions 24 and 25 adjacent anchor point 26 and 27 provided for the side lines 15 and 16 (see FIG. 4). When the ball 20 is in the lock body 20, the kite will be configurated to generate maximum power (FIG. 4). When the ball is released from the body (FIG. 5), so that the control bar 14 can be moved towards the kite, the kite can be depowered.

In order to release, the ball 20 the surfer must rotate the control bar about its longitudinal axis (anti-clockwise in FIG. 4) through about 90° to allow the ball 20 to "tip out" of the body 19.

The surfer is provided with three distinct configurations.

1. The ball 20 is in the lock body 19 (FIG. 2 and FIG. 4) and the harness loop 18 is not hooked to the harness hook 12. The surfer is pulled along by the kite 13 and steers the kite with his hands on the control bar. The wedged forward end 21 of the ball is pressed against the inside of the body. This holds the harness loop parallel to the longitudinal axis of the control bar and makes it easy for the surfer to put the harness loop on to the hook 12.

2. The ball 20 is in the lock body 19 and the harness loop is on the hook 12. The surfer steers with his hands on the control bar and is pulled by the kite through the hook 12. The rear end 22 of the ball is urged against the surface of the lock body between the guide hooks 23. The surfer can take his hands off the control bar and spin the control bar about the central line 17.

3. The ball 20 is out of the lock body and the control bar is away from the body of the surfer (FIG. 5). The surfer is being pulled by the kite via the hook 12 and by his hands. The kite is generally depowered.

The described control device enables the surfer to readily change between the three configurations when required. The locking arrangement is reliable and does not cause abrasions to the central control line in use.

It will be appreciated that other specific forms of locking arrangement can be used in which the shape of the ball 20 or a stopper may take other forms. Any kind of 'stopper' fixed to the central line that can be slotted into an open topped lock body fitted to a central region of the control bar can be used. The stopper is also arranged to be 'tipped' out of the lock body by rotating the control bar to release the central line when required. It is normally preferable however, as explained in the description, that the stopper and lock body are configured or co-operatively shaped to allow relative rotation of the control bar and the central line to untwist the side lines on the one hand. On the other hand the locking arrangement should maintain relative axial orientation of the control bar and the harness loop to facilitate interchange between the three distinct configurations mentioned above.

It will be appreciated that the control device may be used for kites used in sporting activities other than surfing.

I claim:

1. A sports kite power control device comprising an elongate rigid control bar extending either side of a central region to provide separated hand-grippable regions for a kite user adjacent anchor points for respective opposite side control lines of the kite, an open-top lock body mounted to the central region, a central control line attached to a harness loop at one end and extending from the harness loop towards leading edges of the kite, including a stopper rigidly fixed to the central line adjacent a remote end of the central line that can be releasably fitted into the lock body through the open top and when fitted locks the central control line to restrain movement of the central control line relative to the control bar in a direction towards and away from the kite.

2. A sports kite power control device according to claim 1, in which the stopper has a shaped forward end, towards the kite, that can fit snugly against an inner mating surface of the lock body arranged to maintain the axis of the central line in a predetermined relative orientation to the lock body and hence maintain the harness loop in a predetermined relative orientation for easy fitting to a harness hook.

3. A sports kite power control device according to claim 1, in which the stopper has a shaped rear end, away from the kite, that can fit against an inner mating surface of the lock body arranged to permit axial rotation of the central line with respect to the lock body.

4. A sports kite power control device according to claim 3, in which the stopper is an integral component having a wedge shaped forward end and a spherical shaped rear end.

* * * * *